US010753266B2

(12) United States Patent
Karram et al.

(10) Patent No.: US 10,753,266 B2
(45) Date of Patent: Aug. 25, 2020

(54) J-GROOVE FOR CRACK SUPPRESSION

(71) Applicant: GM Global Technology Operations LLC, Detroit, MI (US)

(72) Inventors: Michael A. Karram, Flint, MI (US); Xin Ouang, Oakland, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 122 days.

(21) Appl. No.: 15/981,194

(22) Filed: May 16, 2018

(65) Prior Publication Data

US 2019/0353079 A1 Nov. 21, 2019

(51) Int. Cl.
*F01N 13/18* (2010.01)

(52) U.S. Cl.
CPC ..... *F01N 13/1805* (2013.01)

(58) Field of Classification Search
CPC .... F01N 13/10; F01N 13/1811; F16L 27/073; F16L 9/18; F28F 2265/26
See application file for complete search history.

(56) References Cited

U.S. PATENT DOCUMENTS 4,289,169 A * 9/1981 Banholzer ..... F01N 13/10 138/117
4,289,170 A * 9/1981 Pape ..... F01N 13/08 138/117
2001/0037836 A1* 11/2001 Yoshitoshi ..... B21C 37/0803 138/115
2013/0108429 A1* 5/2013 Sung ..... F01D 9/026 415/205
2016/0160732 A1* 6/2016 Chu ..... F01N 13/105 60/605.1
2018/0340462 A1* 11/2018 Hideshima ..... F01N 13/1827

FOREIGN PATENT DOCUMENTS

DE 102004005462 A1 * 6/2005 ..... F01D 9/026
EP 1808583 A2 * 7/2007 ..... F01D 9/026

* cited by examiner

*Primary Examiner* — Matthew T Largi

(57) ABSTRACT

An exhaust manifold for an internal combustion engine includes a first exhaust port, a second exhaust port, and a septum that separates the first exhaust port and the second exhaust port. The septum has a surface with a J-groove to relieve stresses by looping a tip of a crack initiated by the J-groove back into a stress field of the J-groove.

19 Claims, 3 Drawing Sheets

J-GROOVE FOR CRACK SUPPRESSION

INTRODUCTION

The present disclosure relates to the suppression of cracks in a mechanical component. More specifically, the present disclosure relates to the use of a groove in the mechanical component to suppress cracks in the component.

During the normal operation of certain mechanical components of an internal combustion engine, such as an exhaust manifold, the component experiences extreme temperature variations. These temperature variations induce thermal stresses on the components that may cause cracks in the components. As these cracks propagate, these cracks may compromise the mechanical integrity component. For example, these cracks may compromise the seal between an exhaust manifold and another component to which the manifold is mounted, resulting in leakage between the exhaust manifold and the other component.

Thus, there is a need for a new and improved system for suppressing cracks in mechanical components that experience high thermal stresses.

SUMMARY

According to several aspects, an exhaust manifold for an internal combustion engine includes a first exhaust port, a second exhaust port, and a septum that separates the first exhaust port and the second exhaust port. The septum has a surface with a J-groove to relieve stresses by looping a tip of a crack initiated by the J-groove back into a stress field of the J-groove.

In an additional aspect of the present disclosure, the J-groove has a linear portion and a curved portion with a distal tip.

In another aspect of the present disclosure, the curvature of the curved portion prevents the crack from continuing out the J-groove.

In another aspect of the present disclosure, the length of J-groove determines the amount of stress relief provided by the J-groove.

In another aspect of the present disclosure, the relieved stresses provided by the J-groove prevents the initiation of cracks in other portions of the exhaust manifold.

In another aspect of the present disclosure, the J-groove relieves stresses by about 25%.

In another aspect of the present disclosure, a maximum stress at a distal tip of the J-groove is about 175 MPa.

In another aspect of the present disclosure, the J-groove has a V-shaped notch cross-sectional shape.

In another aspect of the present disclosure, the V-shaped notch is configured to initiate a crack at the bottom of the notch.

In another aspect of the present disclosure, the J-groove has a proximal end and a distal tip, the crack being initiated at the proximal end, the crack propagating from the proximal end to the distal tip and terminating at the distal tip.

According to several aspects, a mechanical component includes a J-groove having a linear portion with a proximal end and a curved portion with a distal tip. The J-groove relieves stresses in the mechanical component by looping a tip of a crack initiated by the J-groove back into a stress field of the J-groove.

In another aspect of the present disclosure, the curvature of the curved portion prevents the crack from continuing out the J-groove.

In another aspect of the present disclosure, the length of J-groove determines the amount of stress relief provided by the J-groove.

In another aspect of the present disclosure, the relieved stresses provided by the J-groove prevents the initiation of cracks in other portions of the mechanical component.

In another aspect of the present disclosure, the J-groove relieves stresses by about 25%.

In another aspect of the present disclosure, a maximum stress at the distal tip of the J-groove is about 175 MPa.

In another aspect of the present disclosure, the J-groove has a V-shaped notch cross-sectional shape.

In another aspect of the present disclosure, the V-shaped notch is configured to initiate a crack at the bottom of the notch.

In another aspect of the present disclosure, the crack is initiated at the proximal end, the crack propagating from the proximal end to the distal tip and terminating at the distal tip.

In another aspect of the present disclosure, an exhaust manifold for an internal combustion engine includes a first exhaust port, a second exhaust port, and a septum that separates the first exhaust port and the second exhaust port, the septum having a surface with a J-groove to relieve stresses by looping a tip of a crack initiated by the J-groove back into a stress field of the J-groove. The J-groove has a V-shaped notch cross-sectional shape. The V-shaped notch is configured to initiate a crack at the bottom of the notch. The cracks initiates at a proximal end of the J-groove and propagates from the proximal end to a distal tip of the J-groove and terminates at the distal tip.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
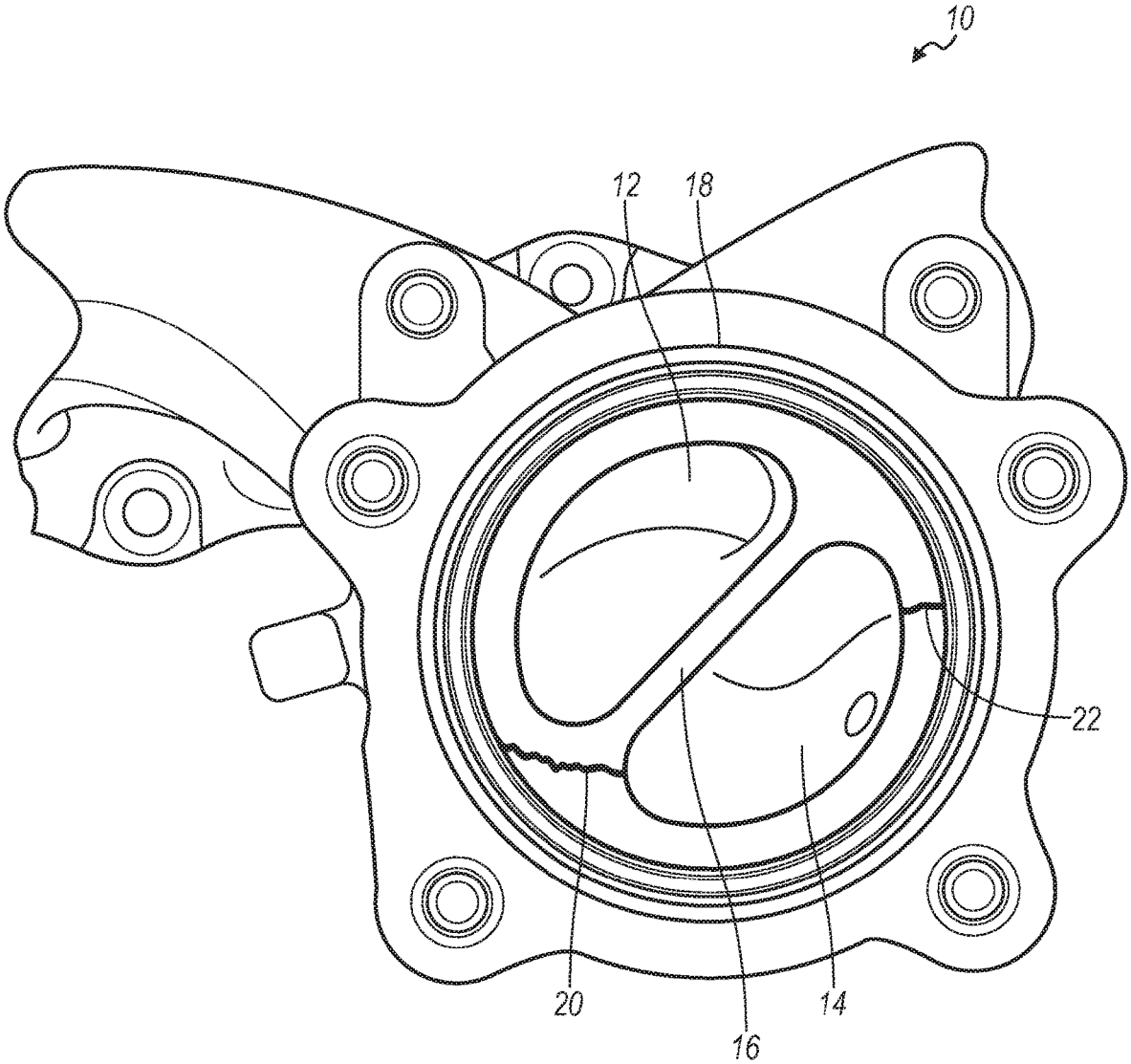
FIG. 1 shows an exhaust manifold with cracks produced by thermal stresses.

Referring to FIG. 1, there is shown a typical exhaust manifold 10 for an internal combustion engine. The exhaust manifold 10 includes a first exhaust port 12 and a second exhaust port 14. The first exhaust port 12 and the second exhaust port 14 are separated by a septum 16 such that each exhaust port 12, 14 provides an exhaust pathway from for example, two cylinders. An exhaust gasket 18 is positioned about the exhaust ports 12, 14 to provide a seal between the exhaust manifold 10 and the mechanical component to which the exhaust manifold 10 is mounted.

During the normal operation of the exhaust manifold 10, the exhaust manifold 10 experiences extreme temperature variations. These variations induce thermal stresses on the components of the exhaust manifold that may cause cracks 20, 22 in the components. These cracks 20, 22 may extend towards the gasket 18, compromising the mechanical integrity of the exhaust manifold which may result in leakage between the exhaust manifold 10 and the component to which the manifold is mounted.

Figure 2:
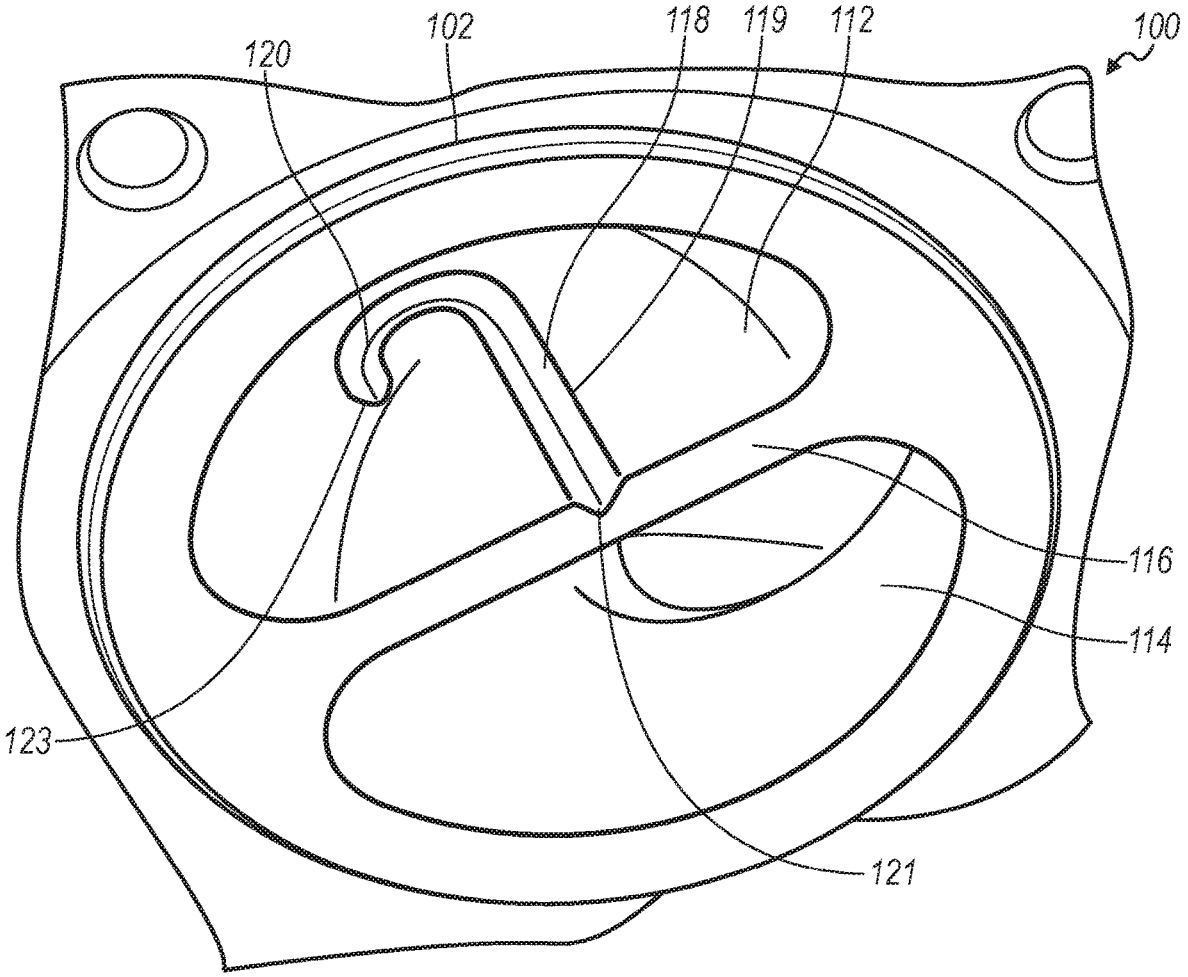
FIG. 2 shows an exhaust manifold with a septum having a J-groove to relieve thermal stresses in accordance with the principles of the present disclosure.
Figure 3:
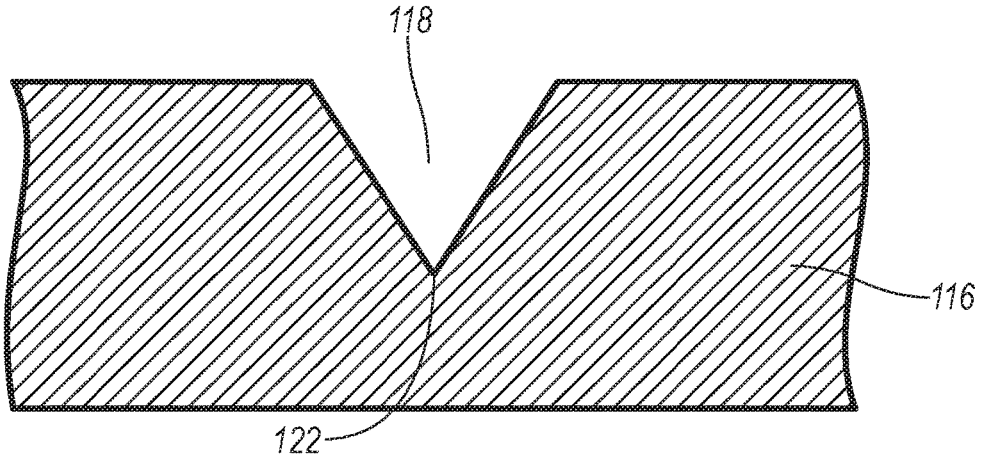
FIG. 3 is a cross-sectional view of the J-groove shown in FIG. 2.

Turning now to FIG. 2, there is shown an exhaust manifold 100 in accordance with the principles of the present disclosure. The exhaust manifold 100 includes a first exhaust port 112 and a second exhaust port 114 surrounded by a gasket 102. The first exhaust port 112 and the second exhaust port 114 are separated by a septum 116. Unlike the septum 16 of the exhaust manifold 10 shown in FIG. 1, the septum 116 has a groove 118.

Referring further to FIG. 2, the groove 118 has a V-shaped cross section with a trough or bottom point 122. The groove 118 has a substantially linear portion 119 a curved portion 120. Hence, the groove 118 has a J-shape with a proximal end 121 and a distal tip 123.

During the operation of the exhaust manifold 100, the exhaust manifold 100 experiences extreme temperature variations similar to those experience by the exhaust manifold 10 describe earlier. These variations induce thermal stresses on the components of the exhaust manifold 100. The J-groove 118, however, concentrates the stresses at the bottom 122 of the J-groove 118 so that the cracks seen in the exhaust manifold 10 do not form in other areas of the exhaust manifold 100.

More specifically, the bottom 122 of the J-groove 118 acts as a crack initiator on the septum 116 to relieve thermal stresses from the rest of components of the exhaust manifold 100. As such, a crack initiates at the proximal end 121 and propagates along the bottom 122. Without the curved portion 120, the crack would possible propagate out of the distal end of the linear portion 119 into the septum 116 where high stresses are concentrated. With the curved portion 120, however, the crack follows along the bottom 188 of the curved portion 120. Accordingly, the crack is turned away from the high stresses at the distal end of the linear portion 119 and back into the normal stress field of the J-groove 118, terminating at the distal tip 123 of the curved portion 120 to suppress further crack propagation.

Figure 4A:
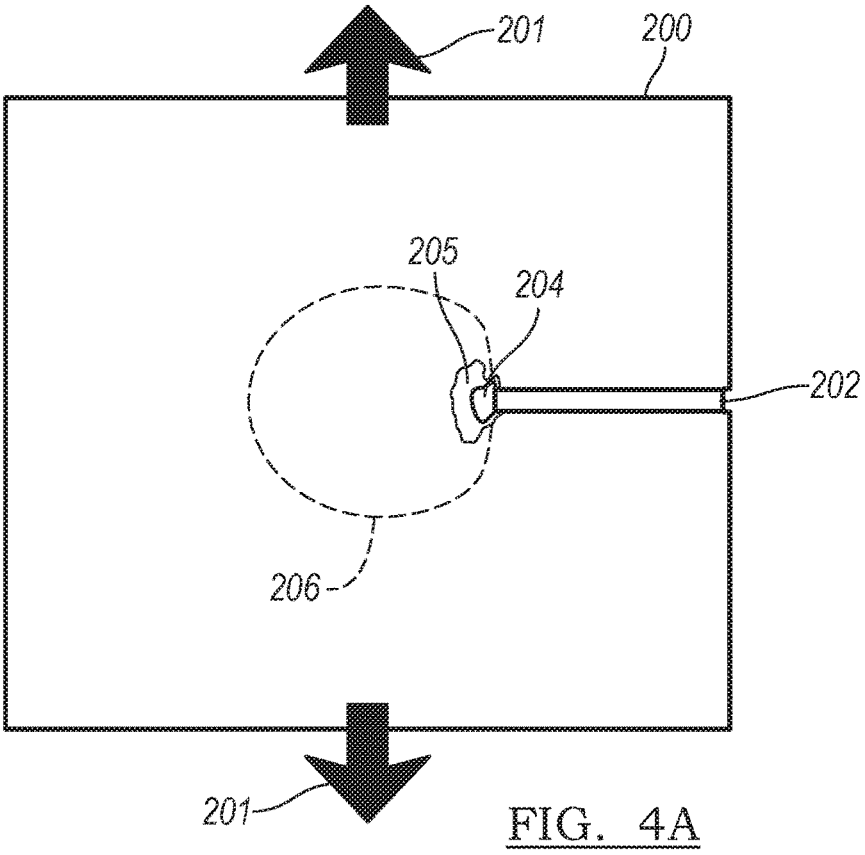
FIGS. 4A and 4B show a comparison of the stress field of a mechanical component without and with a J-groove to relieve thermal stresses in the mechanical component in accordance with the principles of the present disclosure.

The use of the J-groove is applicable to any mechanical component that experiences high stresses. For example, as shown in FIG. 4A, a mechanical component 200 is subjected to tensile forces 201. A groove 202 acts as a crack initiator to relive stresses from the remainder of the mechanical component 200. As such, the crack propagates from the proximal end of the groove 202 at the edge of the mechanical component 200 to a distal end of the groove 202 into a high stress region 204. As the tensile force is continually applied, the crack will continues to propagate towards the opposite edge of the mechanical component as the high stress region 204 propagates along with the tip of the crack into the initial moderate and lesser stress regions 205 and 206, respectively.

Figure 4B:
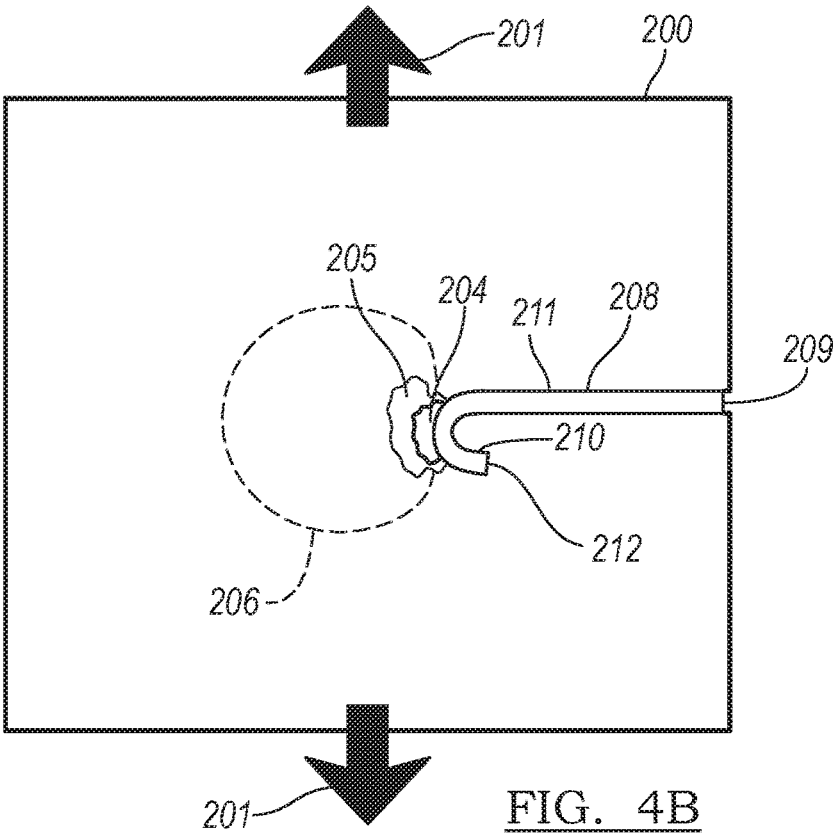

With further reference to FIG. 4B, the mechanical component 200 is again subjected to tensile forces 201. The mechanical component 200, however, now has a J-groove 208 with both a linear portion 211 and a curved portion 210. As the tensile forces 201 are applied to the component 200, a crack initiates at and propagates from a proximal end 209 of the J-groove 208 along the linear portion 211. The crack encounters the high stress region 204. Rather than the crack propagating into the stress regions 204, 205 and 206, the curved portion 210 turns the crack away from these regions 204, 205 and 206 back into the lower stress field surrounding the J-groove 208, in particular, on the side of the linear portion 211. Because of the lower stresses, the crack terminates at the distal tip 212 of the J-groove 208.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An exhaust manifold for an internal combustion engine, the exhaust manifold comprising:

a first exhaust port;

a second exhaust port; and a septum that separates the first exhaust port and the second exhaust port, the septum having a surface with a J-groove, the J-groove having a linear portion that extends along the surface of the septum, the linear portion having a proximal end and a distal end, and a curved portion that extends from the distal end of the linear portion over the surface of the septum to a distal tip to relieve stresses by looping a tip of a crack initiated by the J-groove back into a stress field of the J-groove.

2. The exhaust manifold of claim 1 wherein the curvature of the curved portion prevents the crack from continuing out the J-groove.

3. The exhaust manifold of claim 1 wherein the length of J-groove determines the amount of stress relief provided by the J-groove.

4. The exhaust manifold of claim 1 wherein the relieved stresses provided by the J-groove prevents the initiation of cracks in other portions of the exhaust manifold.

5. The exhaust manifold of claim 1 wherein the J-groove relieves stresses by about 25%.

6. The exhaust manifold of claim 1 wherein a maximum stress at a distal tip of the J-groove is about 175 MPa.

7. The exhaust manifold of claim 1 wherein the J-groove has a V-shaped notch cross-sectional shape.

8. The exhaust manifold of claim 7 wherein the V-shaped notch is configured to initiate a crack at the bottom of the notch.

9. The exhaust manifold of claim 8 wherein the crack initiates at the proximal end of the linear portion, the crack propagating from the proximal end of the linear portion to the distal tip of the curved portion and terminating at the distal tip.

10. A mechanical component comprising:

a J-groove including:

a linear portion that extends along the surface of a septum, the linear portion having a proximal end and a distal end; and a curved portion that extends from the distal end of the linear portion over the surface of the septum to a distal tip, wherein the J-groove relieves stresses in the mechanical component by looping a tip of a crack initiated by the J-groove back into a stress field of the J-groove.

11. The mechanical component of claim 10 wherein the curvature of the curved portion prevents the crack from continuing out the J-groove.

12. The mechanical component of claim 10 wherein the length of J-groove determines the amount of stress relief provided by the J-groove.

13. The mechanical component of claim 10 wherein the relieved stresses provided by the J-groove prevents the initiation of cracks in other portions of the mechanical component.

14. The mechanical component of claim 10 wherein the J-groove relieves stresses by about 25%.

15. The mechanical component of claim 10 wherein a maximum stress at the distal tip of the J-groove is about 175 MPa.

16. The mechanical component of claim 10 wherein the J-groove has a V-shaped notch cross-sectional shape.

17. The mechanical component of claim 16 wherein the V-shaped notch is configured to initiate a crack at the bottom of the notch.

18. The mechanical component of claim 17 wherein the crack initiates at the proximal end of the linear portion, the crack propagating from the proximal end of the linear portion to the distal tip of the curved portion and terminating at the distal tip.

19. An exhaust manifold for an internal combustion engine, the exhaust manifold comprising:

a first exhaust port;

a second exhaust port; and a septum that separates the first exhaust port and the second exhaust port, the septum having a surface with a J-groove, the J-groove having a linear portion that extends along the surface of the septum, the linear portion having a proximal end and a distal end, and a curved portion that extends from the distal end of the linear portion over the surface of the septum to a distal tip to relieve stresses by looping a tip of a crack initiated by the J-groove back into a stress field of the J-groove, wherein the J-groove has a V-shaped notch cross-sectional shape, the V-shaped notch being configured to initiate a crack at the bottom of the notch, and wherein the crack initiates at the proximal end of the linear portion and propagates from the proximal end of the linear portion to the distal tip of the curved portion and terminates at the distal tip.

* * * * *